US006824423B1

(12) United States Patent
Fahl

(10) Patent No.: US 6,824,423 B1
(45) Date of Patent: Nov. 30, 2004

(54) SOCKET ASSEMBLY HAVING REMOVABLE SOCKET FOR USE IN OVERFILL PROTECTION SYSTEMS ON BOTTOM LOADING FUEL TANK TRUCKS

(75) Inventor: Richard L. Fahl, Fairfield, OH (US)

(73) Assignee: Dixon Valve and Coupling Company, Chestertown, MD (US)

( * ) Notice: Subject to any disclaimer, the term of this patent is extended or adjusted under 35 U.S.C. 154(b) by 25 days.

(21) Appl. No.: 10/601,970

(22) Filed: Jun. 23, 2003

(51) Int. Cl.[7] ..... H01R 13/73
(52) U.S. Cl. ..... 439/544; 439/335; 439/573
(58) Field of Search ..... 439/564, 573, 439/544, 546, 335, 311, 314

(56) References Cited

U.S. PATENT DOCUMENTS 2,764,429 A * 9/1956 Betzler ..... 285/189
3,666,886 A * 5/1972 Schneider ..... 358/305
5,328,388 A * 7/1994 Fust et al. ..... 439/544
5,893,777 A * 4/1999 Kantor ..... 439/550
6,364,681 B1 * 4/2002 Watanabe ..... 439/335
6,494,749 B1 * 12/2002 Chang ..... 439/701

* cited by examiner

*Primary Examiner*—Tho D. Ta
(74) *Attorney, Agent, or Firm*—Wood, Herron & Evans, L.L.P.

(57) ABSTRACT

A socket assembly is provided which is part of an overfill protection system for use on a bottom loading fuel tanker truck. The overfill protection system includes a plurality of sensors in the truck compartments which are electrically coupled via wires to the socket assembly. Due to wear, the outer socket of the socket assembly may need to be replaced. The present invention enables an operator to replace the worn socket without having to disconnect the wires from the socket assembly.

18 Claims, 4 Drawing Sheets

SOCKET ASSEMBLY HAVING REMOVABLE SOCKET FOR USE IN OVERFILL PROTECTION SYSTEMS ON BOTTOM LOADING FUEL TANK TRUCKS

FIELD OF THE INVENTION

This invention relates generally to bottom loading fuel tank trucks and more particularly to a socket assembly used in connection with overfill protection systems on such trucks.

BACKGROUND OF THE INVENTION

Cargo tank trucks used to deliver fuel to underground storage tanks at service stations commonly have multiple fuel storage compartments. Each compartment has a manhole cover at the top thereof, a vapor recovery system, and a line communicating with the compartment for loading the compartment with fuel and unloading fuel from the compartment. Each line has a valve assembly at the end thereof to assist in the loading and unloading of fuel.

Typically, these cargo tank truck compartments are loaded from the bottom at what is known in the industry as a loading rack or island. When a fuel storage compartment is loaded from the bottom, the manhole at the top of the compartment remains closed and sealed. Due to the composition of the tank truck compartment, there is no way to visually check the rising fluid level in the compartment to make sure that an overflow does not occur. Therefore, overflow protection systems have been designed to prevent overflows or spills which may cause environmental damage, property damage due to fire and/or human injury.

The primary means used to control the amount of fuel loaded into the compartments of the tank truck are meters which are preset by the truck operator at the loading rack to dispense a predetermined amount of fuel. The pump at the loading rack stops pumping fuel into the truck's compartment once the predetermined amount of fuel has been loaded into the appropriate compartment. Because of the human involvement in this process, errors may occur which may cause the compartment to overfill, thereby causing environmental harm and possibly injury. Such human errors include the operator entering the wrong amount to be dispensed into the truck's compartment or the operator forgetting that some residual fuel remains in the compartment from the last delivery.

In order to reduce these human errors from causing an overfill and subsequent release of fuel into the environment, overfill protection systems have been built into cargo tank trucks. These overfill protection systems include sensing devices located in each of the fuel storage compartments on the truck. The overfill protection system on the truck, when activated, electronically communicates with a monitor at the loading rack to either close valves at the loading rack or shut off the pumps at the loading rack. When the fuel level in a compartment reaches a predetermined level, the sensing device activates the overfill protection system.

Overfill protection systems include a probe or sensor which is mounted at the top of each fuel storage compartment; a socket assembly mounted on the truck and wiring connecting each probe or sensor to the socket assembly. To activate the overfill protection system prior to the loading process, the socket assembly is electrically and mechanically connected to a plug secured at the end of a cable extending from a control monitor at the loading island by an operator. The socket assembly of the overfill protection system must meet American Petroleum Institute (API) standards.

Once the overfill protection system on the truck is electrically connected to the control monitor at the loading island via engagement of the plug with the socket assembly, the control monitor sends an electric signal through the wiring to the sensors mounted at the tops of the fuel storage compartments. If the sensors are functioning properly, a signal is sent to the control monitor on the loading island which in turn sends a signal to the pumps and the loading process occurs. If any of the sensors is wet or not functioning properly, the control monitor sends a signal to the pumps to stop loading. Since their introduction, overfill protection systems have prevented countless accidents.

The dimensional standards of the plug and socket assembly are fixed by the API. The socket assembly on each truck typically includes a plurality of electrically conductive socket pins located in a electrically insulated contact block. For purposes of this application, applicant will refer to the contact block and electrically conductive pins or contacts therein a contact block assembly. The contact block assembly is secured inside a socket. A face plate, fixedly or removably secured to the socket, is removably secured to a housing. Wires connected either to the sensors located in the tops of the tank truck compartments or to an onboard monitoring system are electrically coupled to the pins or contacts of the contact block assembly.

The outer surface of the socket has a plurality of spaced "J" shaped slots which are adapted to receive interlock studs located on the inside of the plug. When the operator desires to electrically connect the plug and the socket assembly to activate the overfill protection system prior to loading, the operator pushes the interlock studs on the inside of the plug into the "J" shaped slots of the socket and then rotates the plug. The plug and socket assembly are then electrically and physically engaged with each other so they may electronically communicate. Due to the excessive number of loadings of each tank truck, over time these "J" shaped slots wear and no longer are able to function properly, i. e. no longer are able to secure the plug to the socket assembly at the loading island. Consequently, the socket with the worn "J" shaped slots must be replaced.

In previous socket assemblies, to prevent the contact block assembly, to which the wires are attached, from being pushed rearwardly through the socket when the plug and socket assembly are engaged, the socket has an integral lip on the inner surface of a passage therethrough which abuts a shoulder on the contact block. Therefore, to remove and replace a worn socket of a socket assembly, the contact block with the wires attached must be passed forwardly through the passage in the socket. In order to remove and replace the worn socket, an operator must individually remove each of the wires from the contact block assembly. When an operator is forced to remove individual wires from the contacts of the contact block assembly, often the operator forgets which contact gets reconnected to which wire. The result is that the socket assembly is unable to be rewired, or is rewired incorrectly, thereby rendering the overfill protection system inoperative.

Therefore, there is a need for a socket assembly having a socket which may be replaced quickly and easily without an operator having to remove the wiring from the remainder of the socket assembly.

SUMMARY OF THE INVENTION

The invention of this application which accomplishes these and other objectives comprises a socket assembly adapted to be electrically coupled to sensors of an overfill protection system for use on a bottom loading fuel tanker truck. The socket assembly is configured to enable an operator to replace a worn socket without rewiring the socket assembly.

The socket assembly of the present invention comprises a housing to which is secured a face plate. Wires extending from sensors or probes located in the tops of the truck's fuel storage compartments pass through an opening in the housing, an opening in the face plate, and are coupled to electrical contacts or pins forming part of a contact block assembly. These wires, sensors and the socket assembly of the present invention make up an overfill protection system on the tank truck. The overfill protection system is activated by an operator by engaging a plug secured to the end of a cord extending from a control monitor located on a loading island with the socket assembly of the present invention.

The socket assembly of the present invention further comprises a socket removably secured to the face plate. The socket is preferably made of electrically conductive material but may be made of any material. The socket has a passage therethrough which is sized and adapted to receive and retain a contact block assembly.

The socket has a plurality of slots on an exterior surface thereof. Although these slots are preferably "J" shaped, they may assume other configurations or shapes without departing from the spirit of the present invention. These slots on the socket are adapted to receive and retain a plurality of spaced interlock studs extending radially inwardly on the inside of a plug electrically coupled to the control monitor at the loading island. The location of these interlock studs and socket slots varies depending upon the type of overfill protection system utilized on any particular tank truck. When the plug is electrically and mechanically coupled to the socket assembly of the present invention, the overfill protection system is activated.

Another part of the socket assembly of the present invention is a contact block assembly which comprises a contact block made of electrically insulative material and a plurality of electrically conductive contacts. Preferably, the electrically conductive contacts are metal pins secured in holes passing through the interior of the contact block. However, the electrical contacts may be other items without departing from the spirit of the present invention. The contact block is preferably made of plastic but may be made of any electrically insulative material such as rubber.

In order to prevent the contact block assembly from being pushed rearwardly through the opening in the face plate, the contact block has a shoulder inherently built therein which abuts against the face plate. When the plug extending from the control monitor at the loading island is engaged with the socket assembly to activate the overfill protection system, the operator must push the electrical contacts on the plug into engagement with the electrical contacts of the contact block assembly of the socket assembly of the present invention. Additionally, the operator must pass the interlock studs on the plug into the slots located on the exterior of the socket and twist, thereby locking the plug and socket together.

In use, when the socket of the socket assembly becomes worn due to excessive wear, in particular the slots of the socket, the socket must be removed and replaced. In previous socket assemblies, the operator had to disconnect the wires of the overfill protection system from the socket assembly of the system before the socket could be removed and replaced. In the present invention, the socket may be removed and replaced without the operator having to remove the wires from the socket assembly.

In order to replace a worn socket using the socket assembly of the present invention, an operator first removes the face plate from the housing. The operator then removes the worn socket from the face plate by removing the fasteners which secure the face plate to the socket. The operator's next step is to remove the contact block assembly from the inside the passage of the worn socket by removing the fastener securing the contact block assembly to the worn socket. The contact block assembly, which still has the wires secured thereto, is passed rearwardly through the passage in the worn socket so that the worn socket may be removed and replaced. The contact block assembly, with the wires attached thereto, does not pass rearwardly though the opening in the face plate during this process. Instead, the wires remain extending through the opening in the face plate.

To put the socket assembly back together without disturbing the wires of the overfill protection system, a new socket is secured to the contact block assembly. The new socket with the contact block assembly secured in the passage of the new socket is then secured to the face plate. The last step is securing the face plate to the housing. Using this process, a worn socket may be removed and replaced more easily than heretofore possible because the wires need not be separated from the socket assembly.

These and other objects and advantages of the present invention will be more readily apparent from the following drawings.

DETAILED DESCRIPTION OF THE INVENTION

Figure 1:
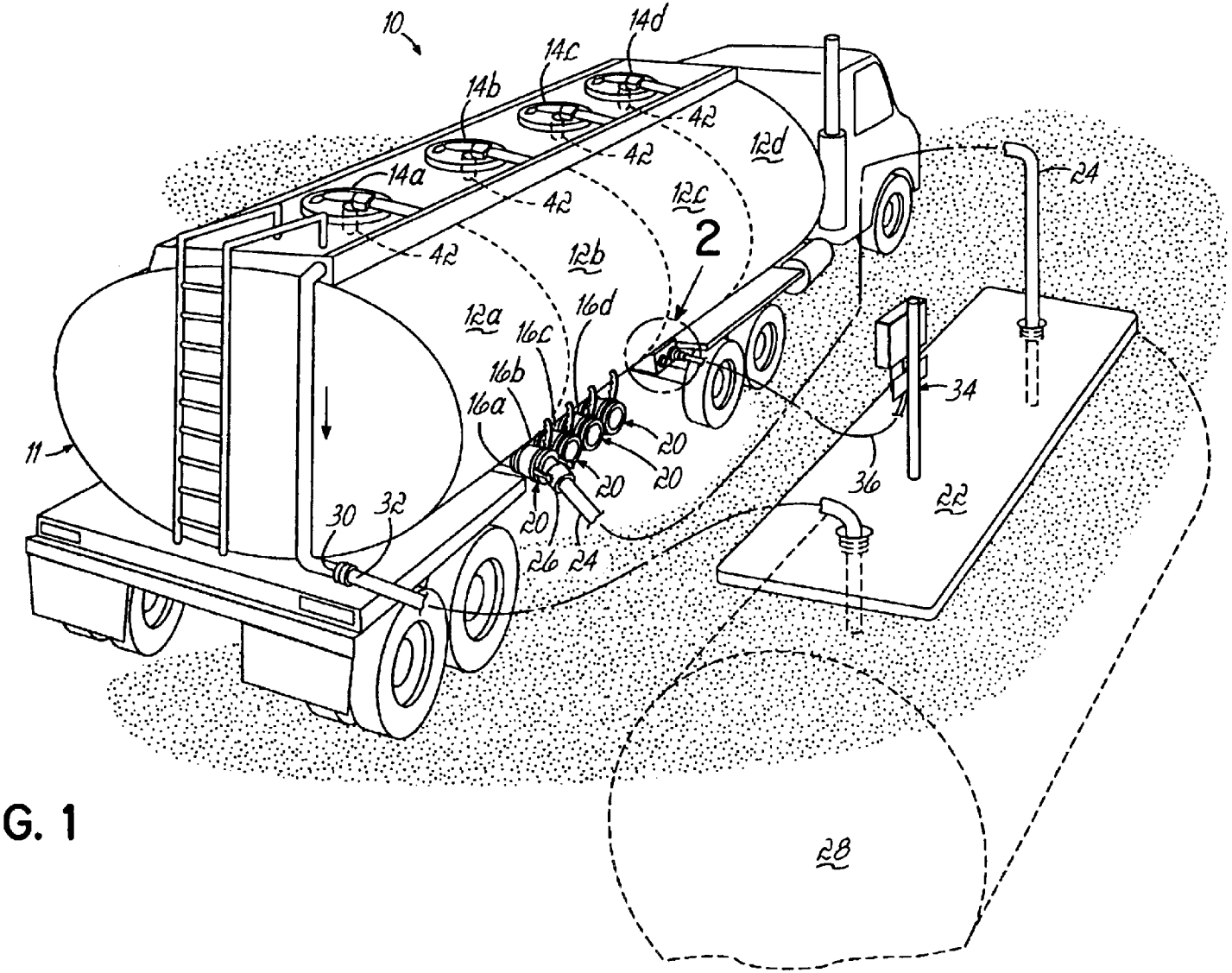
FIG. 1 is a perspective view of a fuel tanker truck being loaded with fuel at a loading island.

Referring to the figures and particularly FIG. 1 there is illustrated a fuel tanker truck 10 having a tank 11 with four compartments 12*a*, 12*b*, 12*c*, and 12*d* having respective covers 14*a*, 14*b*, 14*c*, and 14*d*. Although the compartments are illustrated by dashed lines, these dashed lines are for illustration purposes only. The truck may have any number of compartments in any location. Below the tank 11 are a plurality of pipes 16*a*, 16*b*, 16*c*, and 16*d* in fluid communication with the compartments 12*a*, 12*b*, 12*c*, and 12*d*, respectively. Each of the pipes 16*a*, 16*b*, 16*c*, and 16*d* has a valve assembly 20 located at the end thereof for loading fuel into the compartments and unloading fuel from the compartments in a manner known in the art.

Fuel is loaded into the truck compartments 12*a*, 12*b*, 12*c*, and 12*d* at a loading rack or island 22. The loading rack 22 has at least one dispensing line 24 which draws fuel from a fuel supply 28 via a pump (not shown). The end of the dispensing line 24 is mechanically coupled to the valve assembly 20 via a coupler 26 in a manner known in the art. Although one configuration of loading rack 22 is illustrated and described, any number of different loading racks may be used in accordance with the present invention.

Although FIG. 1 illustrates the fuel supply 28 being in the form of a tank located underneath the loading island 22, the fuel supply 28 may assume other forms and may be remotely located from the loading island 22. Similarly, although one dispensing line or hose 24 is illustrated being connected to pipe 16*a* to fill compartment 12*a*, any number of dispensing lines may be operational at the same time to fill multiple truck compartments simultaneously. The truck compartments may be filled with different types of fuel drawn from different fuel supplies.

A vapor recovery fitting 30 forms part of the truck 10 and is connected to a vapor recovery hose 32 which extends between the vapor recovery fitting 30 and the supply tank 28, as is conventional in the art to prevent vapors from escaping to the atmosphere. The dispensing line 24, coupler 26, hoses 24, 32, vapor recovery fitting 30 and fuel supply 28 are all conventional in the art and are not considered a part of the present invention. The invention of the present application is not intended to be limited by the number, configuration or operation of these items.

Figure 1A:
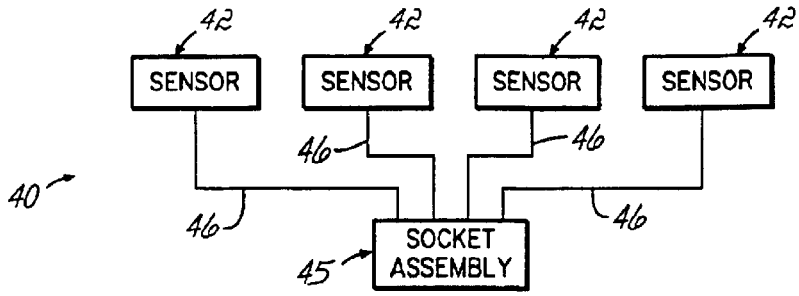
FIG. 1A is a block diagram of an overfill protection system used in accordance with the present invention.

The truck 10 is equipped with an overfill protection system 40 shown in schematic form in FIG. 1A. The overfill protection system 40 comprises a plurality of probes or sensors 42 located at the tops of each of the compartments 12*a*, 12*b*, 12*c* and 12*d*. See FIG. 1. The probes or sensors 42 are electrically coupled to a dual socket assembly 45 via wires 46 in a manner known in the art. See FIGS. 1A, 4 and 5. The socket assembly 45 is the subject of the present invention and will be described in more detail below.

Figure 2:
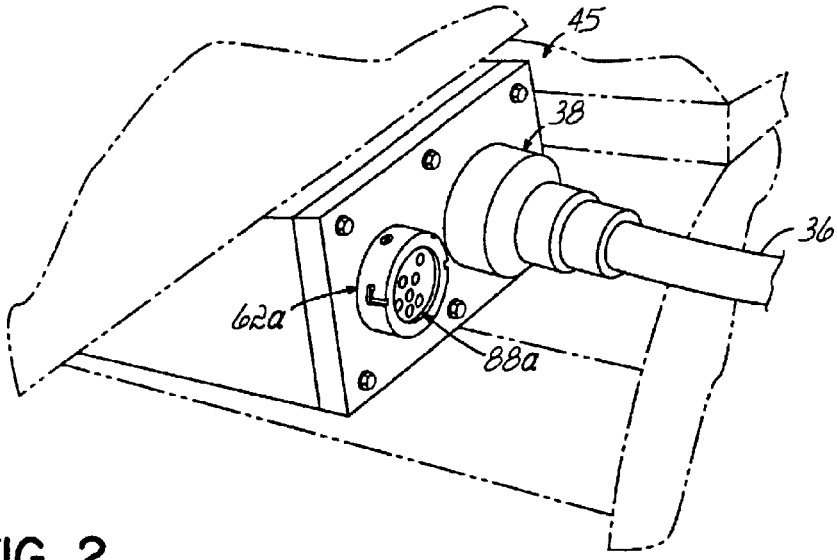
FIG. 2 is a enlarged view of the circled area 2 of FIG. 1, a plug being secured to one preferred embodiment of socket assembly of the present invention.
Figure 3:
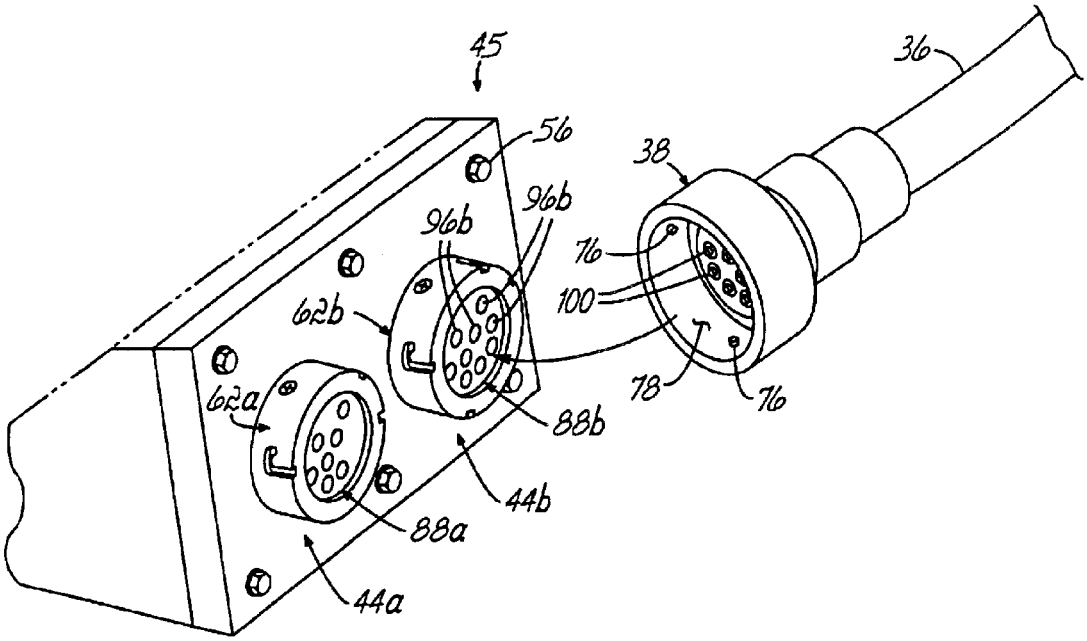
FIG. 3 is a perspective view of the embodiment of socket assembly of the present invention shown in FIG. 2, the plug being disconnected from the socket assembly.

At the loading island 22 is a control or overfill protection monitor 34 which has a cable 36 extending outwardly therefrom. A plug 38, best illustrated in FIGS. 2 and 3, is secured to the end of cable 36. In operation, to activate the overfill protection system 40 on the truck 10, an operator engages the plug 38 at the end of cable 36 with the socket assembly 44 of the present invention. Once the overfill protection system 40 on the truck 10 is activated, the overfill protection monitor 34 on the loading island 22 sends an electronic signal through the wires 46 on the truck to the sensors or probes 42. If the sensors are dry and functioning properly, a return signal is received back at the overfill protection monitor 34 which in turn, sends an electronic signal to the pumps at the loading station 22 and filling begins. If the return signal received at the overfill protection monitor 34 is not proper due one of the sensors 42 being wet or not functioning properly, then the pumps are not turned on or turned off.

One embodiment of the present invention, illustrated in detail in FIGS. 2-6, utilizes two socket assemblies 44*a*, 44*b*, each built in accordance with the present invention. The socket assemblies 44*a*, 44*b* are incorporated into a dual socket assembly 45. The socket assemblies 44*a*, 44*b* are slightly different in order to be able to communicate with different plugs at different loading islands. Any number of socket assemblies in accordance with the present invention may be incorporated into an overfill protection system on a truck.

Figure 4:
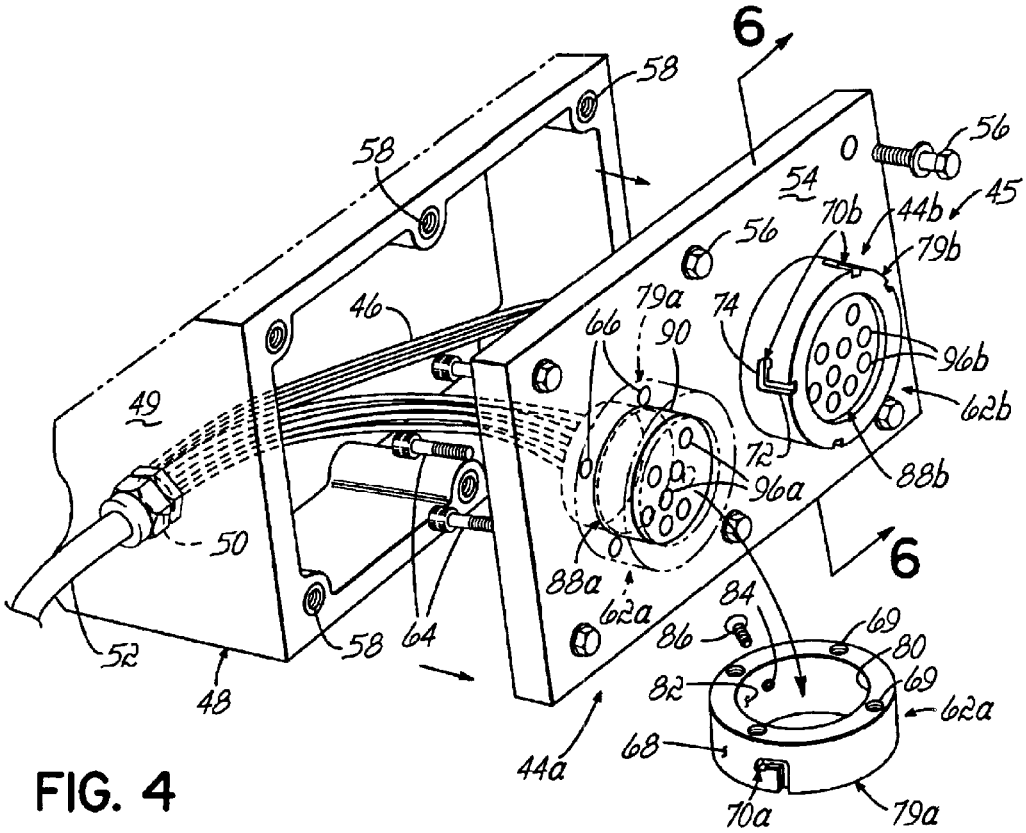
FIG. 4 is a partially disassembled view of the socket assembly of FIGS. 2 and 3.
Figure 5:
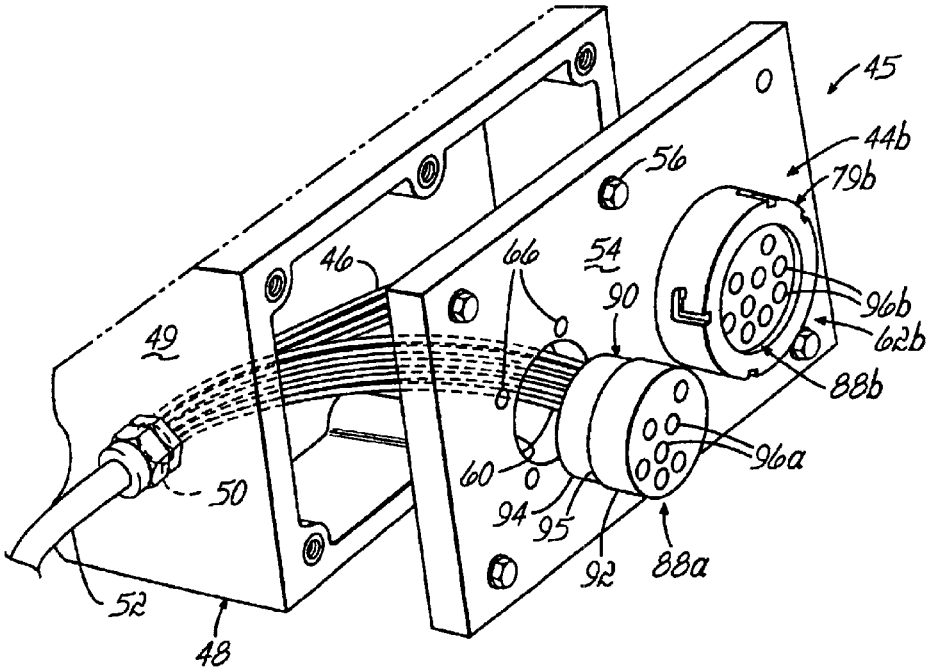
FIG. 5 is a further disassembled view of the socket assembly of FIGS. 2 and 3.

Referring to FIGS. 4 and 5, the dual socket assembly 45 comprises a housing 48 having an opening 50 through which the wires 46 of the overfill protection system 40 pass. Although the wires 46 are illustrated as passing through a side 49 of the housing 48, they may pass into the housing at any desired location. The wires 46 are enclosed in a sheath 52 outside the housing, as is conventional. A face plate 54 is removably secured to the housing 48 with a plurality of fasteners 56 which engage openings 58 in the housing 48. Although fasteners 56 are illustrated as being six bolts, they may be any type and/or any number of fasteners.

As best illustrated in FIG. 5, the face plate 54 has an opening 60 therethrough. Although the opening 60 in the face plate is illustrated as being circular, it may be any configuration desired and may be at any desired location.

As best illustrated in FIG. 4, a socket 62*a*, preferably made of electrically conductive material, is removably secured to the face plate 54 with four fasteners 64 (only three being shown). The fasteners 64, illustrated as being screws, engage holes 66 extending through the face plate 54 and into threaded holes 69 in socket 62*a*. Although four holes 66 and four fasteners 64 are described, any number of holes and fasteners may be used to secure the socket 62 to the face plate 54. Again, the fasteners 64 may be any type of fasteners.

As shown in FIG. 4, the socket 62*a* has an outer surface 68 in which are located a plurality of spaced "J" shaped slots 70*a*. Similarly, socket 62*b* has a plurality of spaced "J" shaped slots 70*b*; however, slots 70*b* are at different locations than those of socket 62*a*. As shown in FIG. 4, each of the "J" shaped slots 70*a*, 70*b* has a linear portion 72 and an arcuate portion 74. These "J" shaped slots 70*a*, 70*b* are adapted to engage a plurality of interlock studs 76 extending radially inwardly from an inner surface 78 of the plug 38 in order to couple the plug 38 to one of the sockets 62*a*, 62*b*. See FIGS. 2 and 3. Due to the slightly different configurations of the socket assemblies 44*a*, 44*b*, only one of the two socket assemblies 44*a*, 44*b* is able to engage the plug 38 located at the loading island 22. FIG. 2 illustrates plug 38 being secured to socket assembly 44*b*.

As best shown in FIG. 4, the socket 62*a* has a body 79*a* with a passage 80 therethrough. The size of the passage 80 is defined by an inner surface 82 of the body 79*a* of the socket 62*a*. The inner surface 82 of the body 79*a* of the socket 62*a* is generally smooth, thereby enabling a contact block assembly 88*a* to pass therethrough in a manner described below. Prior art sockets were not smooth but had a lip or shoulder integrally built therein which prevented the contact block assembly from passing rearwardly through the socket. A hole 84 extends through the socket 62*a* as shown in FIG. 4 and receives and retains fastener 86 in order to removably secure a contact block assembly 88*a* in the passage 80 of the socket 62*a*. The engagement of the fastener 86 in the hole 84 of the socket 62*a* prevents rotation of the contact block assembly 88*a* in the passage 80 of the socket 62*a*. Any other means of preventing the contact block assembly 88*a* from rotating relative to the socket 62*a* may be used.

Figure 6:
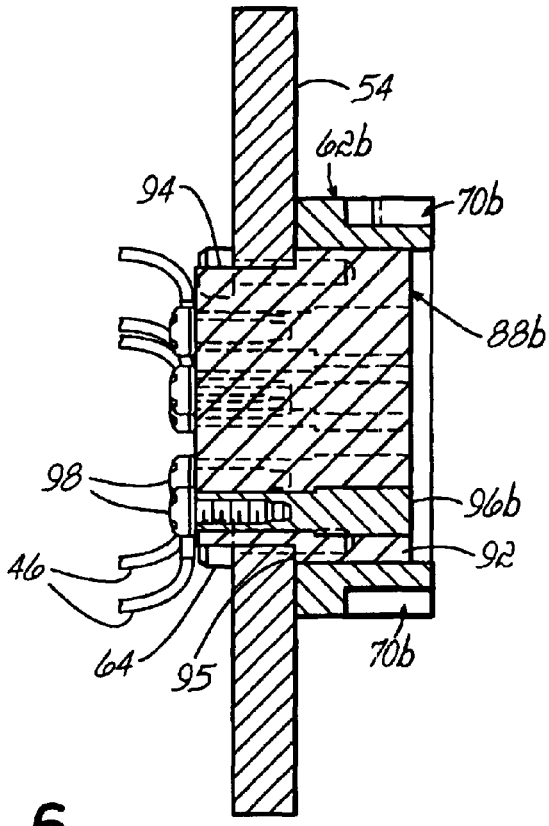
FIG. 6 is a cross sectional taken along the line 6—6 of FIG. 4.

As best shown in FIG. 6, the contact block assembly 88*a* comprises a contact block 90 having a first portion 92 of a first diameter and a second portion 94 of a second diameter smaller than the first diameter. Between the first and second portions 92, 94 is a shoulder 95 which abuts the face plate 54 when the socket assembly 44 is in an assembled condition. See FIG. 6. The contact block 90 is made of electrically insulative material, preferably plastic, but may be made of other non-conductive materials. Inside the contact block 90 are a plurality of pins 96 made of conductive material as shown in FIG. 6. Any other type of electrical contact may be utilized in the contact block assembly 88*a* without departing from the spirit of the invention.

In order to electrically couple the wires 46 to the socket assembly 62*a* and more particularly to the contact block assembly 88, a plurality of fasteners 98 are used as seen in FIG. 6. The fasteners 98 pass through eyelets located at the ends of the wires 46, as is conventional. When the wires 46 are electrically connected to the contacts or pins 96 of the contact block assembly 88*a* at the rear of the contact block assembly 88*a*, great care must be taken to ensure that each wire 46 is coupled to the correct pin or contact 96. If these connections are accidentally reversed or incorrectly made, the overfill protection system 40 on the truck 10 will not operate correctly. In previous socket assemblies, in order to replace a worn socket, an operator had to disassemble these wires from the socket assembly and put them back in their correct location. This is not a simple task. The present invention allows an operator to quickly and easily replace a worn socket without having to disconnect any wires.

The opening 60 in the face plate 54 is specifically sized to allow the second portion 94 of the contact block 90 to pass therethrough but not the first portion 92 of the contact block. Consequently, when the socket assembly 44*a* is assembled and the plug 38 engaged with the socket assembly 44*a*, the contact block assembly 88*a* is prevented from being pushed rearwardly through the opening 60 in the face plate 54.

As shown in FIG. 2, when the plug 38 and the socket 62*a* are mechanically coupled together via engagement of the interlock studs 76 of the plug 38 with the "J" shaped slots 70 on the socket 62*a*, the location of the pins or contacts 96 of the contact block assembly 88*a* contact a plurality of electrical contacts 100 located in the plug 38. See FIG. 3. Thus, the locations of the electrical contacts 96, 100 ensure the overfill protection system 40 on the truck 10 may electronically communicate with the monitor 34 on the loading island 22.

In order to remove and replace a worn socket 62*a* of a socket assembly 44*a*, the fasteners 56 are removed from the openings 58 in the housing 48. The face plate 54 is then removed from the housing 48 in a manner shown in FIG. 4. The four fasteners 64 are then removed from engagement with the socket 62*a* in order to remove the worn socket 62*a* from the face plate. At this point the contact block assembly 88*a* is still secured to the worn socket 62*a* with fastener 86. The wires 46 extend through the opening 60 in the face plate 54 as shown in FIG. 5. The next step is to remove the contact block assembly 88*a* from the worn socket 62*a* by removing fastener 86, the wires 46 still being attached to the contact block assembly 88. The worn socket 62*a* is either pulled forwardly away from the contact block assembly 88*a* or the contact block assembly 88*a* pushed rearwardly through the passage 80 in the worn socket 62. In either event, the wires 46 remain attached to the contact block assembly 88*a* and need not be removed from the contact block assembly 88*a*.

Once a new socket is located, the contact block assembly 88, with the wires 46 attached, is secured to the new socket with fastener 86. The face plate 54 is then secured to the new socket having the contact block assembly 88 secured therein using fasteners 64. The last step is to secure the face plate 54 to the housing 48 with fasteners 56.

Figure 7:
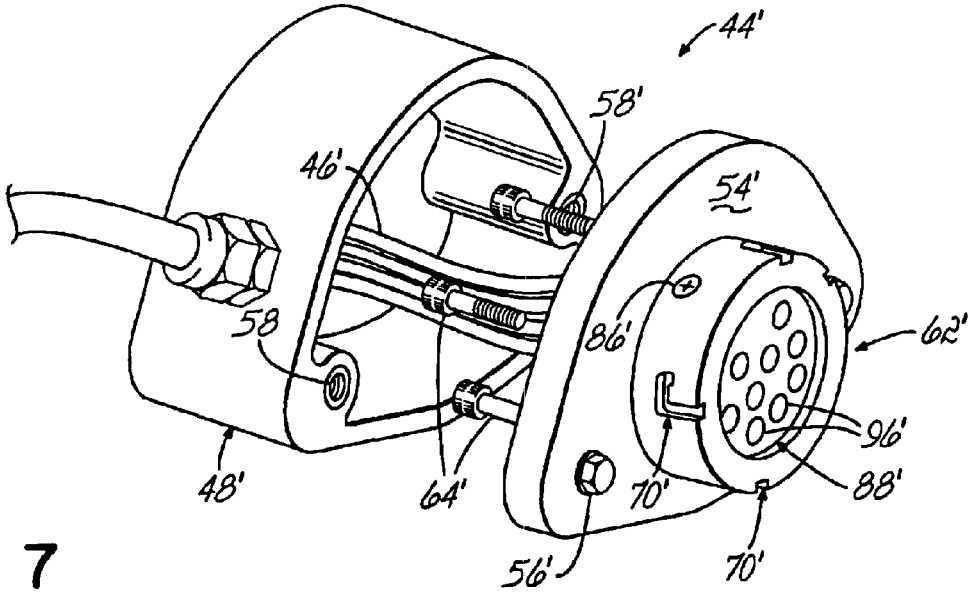
FIG. 7 is a disassembled view of another preferred embodiment of socket assembly in accordance with the present invention.

FIG. 7 illustrates an alternative embodiment of the socket assembly of the present invention. In this embodiment, only one socket assembly 44' is located inside a housing 48', as opposed to two socket assemblies. Socket assembly 44' comprises a face plate 54' secured to housing 48' with fasteners 56', a socket 62' having slots 70', a contact block assembly 88' secured to socket 62' with fastener 86'. The socket 62' is secured to the face plate 54' with fasteners 64'. In all respects, the socket assembly 44' functions as do the socket assemblies 44*a*, 44*b* described above.

Although the present invention has been illustrated and described in the context of tank trunks, the socket assembly of the present invention may be used in other environments.

Although I have described several preferred embodiments of my invention, I do not intend to be limited except by the scope of the following claims.

I claim:

1. A socket assembly adapted to be electrically coupled to sensors of an overfill protection system for use on a fuel tanker truck, said socket assembly comprising:

a face plate having an opening therethrough;

a socket removably secured to said face plate, said socket having a passage therethrough;

a contact block located inside said passage of said socket, said contact block having a shoulder which abuts said face plate to prevent said contact block from being pushed rearwardly through said opening in said face plate;

a plurality of electrically conductive contacts in said contact block adapted to be electrically coupled to wires extending from said sensors;

wherein said socket may be removed and replaced without having to disconnect said wires from said contacts.

2. The socket assembly of claim 1 wherein said contact block is made of electrically insulative material.

3. The socket assembly of claim 1 wherein said contact block is made of plastic.

4. The socket assembly of claim 1 wherein said contact block may be pushed rearwardly through said passage in said socket after said face plate is separated from said socket.

5. The socket assembly of claim 1 wherein said socket has a plurality of slots adapted to receive interlock studs of a plug when said plug and said socket assembly are coupled together.

6. The socket assembly of claim 5 wherein said slots of said socket are J-shaped.

7. A socket assembly adapted to be electrically coupled to sensors of an overfill protection system for use on a fuel tanker truck, said socket assembly comprising:

a face plate having an opening therethrough;

a socket removably secured to said face plate with at least one fastener extending through said face plate and into said socket, said socket having a passage therethrough;

a contact block assembly removably secured inside said passage of said socket, said contact block assembly including a contact block made of electrically insulative material and a plurality of electrically conductive pins adapted to receive wires from said sensors;

wherein after said face plate is removed from said socket, said contact block assembly may be pushed outwardly through said passage of said socket without having to disconnect said wires from said pins in order to remove and replace said socket.

8. The socket assembly of claim 7 wherein said socket has a plurality of J-shaped slots adapted to receive interlock studs of a plug when said plug and said socket assembly are coupled together.

9. The socket assembly of claim 7 wherein said contact block is made of plastic.

10. The socket assembly of claim 7 wherein said contact block has a shoulder which abuts said face plate to prevent contact block from passing through said opening in said face plate.

11. The socket assembly of claim 7 wherein at least one fastener removably secures said contact block to said socket.

12. A socket assembly comprising part of an overfill protection system for use on a fuel tanker truck, said socket assembly being adapted to be electrically coupled to a plug at the end of a cable at a loading rack, said socket assembly comprising:

a face plate having an opening therethrough;

a socket removably secured to said face plate with at least one fastener extending through said face plate and into said socket, said socket having a passage therethrough;

a contact block assembly removably secured inside said passage of said socket to which wires of said overfill protection system may be electrically coupled;

wherein after said face plate is separated from said socket and said contact block assembly separated from said socket, said contact block assembly may be passed through said passage of said socket so that said socket may be replaced without having to disconnect said wires from said contact block assembly.

13. The socket assembly of claim 12 wherein said socket has a plurality of J-shaped slots adapted to receive interlock studs of a plug when said plug and said socket assembly are coupled together.

14. The socket assembly of claim 12 wherein at least one fastener removably secures said contact block assembly to said socket.

15. The socket assembly of claim 12 wherein said contact block assembly includes a contact block made of electrically insulative material and a plurality of electrically conductive pins adapted to receive wires from said sensors.

16. The socket assembly of claim 15 said contact block is made of plastic.

17. The socket assembly of claim 15 wherein said contact block has a shoulder which abuts said face plate to prevent said contact block from passing through said opening in said face plate.

18. A socket assembly comprising:

a face plate having an opening therethrough;

a socket removably secured to said face plate with at least one fastener extending through said face plate and into said socket said socket having a passage therethrough;

a contact block made of electrically insulative material removably secured inside said passage of said socket;

a plurality of electrically conductive contacts in said contact block adapted to be electrically coupled to wires;

wherein said socket may be removed and replaced without having to disconnect said wires from said contacts.

* * * * *

UNITED STATES PATENT AND TRADEMARK OFFICE

CERTIFICATE OF CORRECTION

PATENT NO. : 6,824,423 B1
DATED : November 30, 2004
INVENTOR(S) : Richard L. Fahl It is certified that error appears in the above-identified patent and that said Letters Patent is hereby corrected as shown below:

Column 2,
Line 19, change “therein a contact” to -- therein as a contact --.

Column 4,
Line 6, change “from the inside the passage” to -- from inside the passage --.

Column 5,
Line 53, change “due one” to -- due to one --.

Column 8,
Line 7, change “tank trunks” to -- tank trucks --.
Line 56, change “outwardly” to -- rearwardly --.

Column 9,
Lines 2-3, change “prevent contact” to -- prevent said contact --.

Column 10,
Line 8, change “15 said” to -- 15 wherein said --.
Line 18, change “socket said” to -- socket, said --.

Signed and Sealed this

Twenty-fourth Day of May, 2005

JON W. DUDAS
*Director of the United States Patent and Trademark Office*